US006978953B2

(12) United States Patent
Graham

(10) Patent No.: US 6,978,953 B2
(45) Date of Patent: Dec. 27, 2005

(54) PULVERISER AND METHOD OF PULVERISING

(75) Inventor: William Graham, Somerset West (ZA)

(73) Assignee: Power Technologies Investment Limited, Tortola (VG)

( * ) Notice: Subject to any disclaimer, the term of this patent is extended or adjusted under 35 U.S.C. 154(b) by 0 days.

(21) Appl. No.: 10/750,901

(22) Filed: Jan. 5, 2004

(65) Prior Publication Data

US 2004/0251343 A1 Dec. 16, 2004

Related U.S. Application Data

(63) Continuation of application No. 09/792,061, filed on Feb. 26, 2001, now Pat. No. 6,722,594, which is a continuation of application No. PCT/AZ99/00074, filed on Aug. 30, 1999.

(30) Foreign Application Priority Data

Sep. 4, 1998 (GB) ..... 9819398

(51) Int. Cl.[7] ..... B02C 19/06
(52) U.S. Cl. ..... 241/5
(58) Field of Search ..... 241/5, 39, 301

(56) References Cited

U.S. PATENT DOCUMENTS

| | | | | |
|---|---|---|---|---|
| 1,614,314 | A | 1/1927 | Murray | |
| 2,832,545 | A | 4/1958 | Segraves | |
| 3,255,793 | A | 6/1966 | Clute | |
| 3,876,156 | A | 4/1975 | Muschelanautz et al. | |
| 3,888,425 | A | 6/1975 | Collins | |
| 4,059,231 | A | 11/1977 | New | |
| 4,390,131 | A | 6/1983 | Pickrel | 241/1 |
| 4,391,411 | A | 7/1983 | Colburn | |
| 4,418,871 | A | 12/1983 | Powell | |
| 5,765,766 | A | 6/1998 | Yoshida et al. | |
| 6,170,768 | B1 | 1/2001 | Harmon et al. | |
| 6,722,594 | B2 | 4/2004 | Graham | 241/39 |
| 2004/0200910 | A1 | 10/2004 | Graham et al. | 241/5 |

FOREIGN PATENT DOCUMENTS

| | | |
|---|---|---|
| DE | 197 47 628 A 1 | 5/1999 |
| EP | 0 079 300 A | 10/1985 |
| FR | 2 311 588 A | 12/1976 |
| FR | 2661450 | 4/1990 |
| GB | 313 582 A | 5/1929 |
| GB | 591 921 A | 2/1947 |
| GB | 911 454 | 11/1962 |
| GB | 2357712 | 10/2002 |
| JP | 01125554 | 5/1989 |

(Continued)

OTHER PUBLICATIONS

U.K. Patent Office Search Report for GB0406494.5, dated Nov. 10, 2004, 1 pg.

(Continued)

*Primary Examiner*—Mark Rosenbaum
(74) *Attorney, Agent, or Firm*—John R. Thompson; Stoel Rives LLP

(57) ABSTRACT

A pulveriser is disclosed which comprises a fan which sucks air through a pipe. A hopper receives material which is to be pulverised, the hopper having an open lower end which communicates with the pipe. Between the hopper and the fan there is a venturi. Air flows through the venturi at a speed of Mach 1 or above. Pieces of frangible material dropped into the hopper are sucked to the venturi where they are blown apart and reduced to powder.

16 Claims, 3 Drawing Sheets

FOREIGN PATENT DOCUMENTS

| | | | |
|---|---|---|---|
| JP | 2-251535 | A1 | 10/1990 |
| JP | 11 160 290 | A | 6/1999 |
| WO | 92/12795 | A | 6/1992 |
| WO | 93/12884 | | 7/1993 |
| WO | 99/53130 | | 10/1999 |
| WO | 00/13799 | A | 3/2000 |
| WO | WO 01/03840 | A1 | 6/2001 |
| WO | 02/08630 | | 1/2002 |
| WO | 03/006166 | A1 | 1/2003 |

OTHER PUBLICATIONS

U.S. Appl. No. 10/706,240, Graham et al., filed Nov. 12, 2003.

U.S. Appl. No. 10/816,124, Graham, filed Apr. 1, 2004.

Annex to Form PCT/ISA/206, Communication Relating to the Results of the Partial International Search for PCT/ZA2004/000126, 2 pgs.

PCT Invitation to Pay Additional Fees and Annex to Form PCT/ISA/206, Communication Relating to the Results of the Partial International Search for PCT/ZA2005/000006, 5 pgs.

PULVERISER AND METHOD OF PULVERISING

CROSS-REFERENCE TO RELATED APPLICATIONS

This application is a continuation of application Ser. No. 09/792,061, filed Feb. 26, 2001 now U.S. Pat No. 6,722,594, which is a continuation of PCT/ZA99/00074, filed Aug. 30, 1999, in the name of William Graham, which is incorporated by reference in its entirety herein, and which claims priority to GB 9819398, filed on Sep. 4, 1998.

FIELD OF THE INVENTION

THIS INVENTION relates to pulverisers and to a method of pulverising.

BACKGROUND TO THE INVENTION

In many industries it is necessary to reduce pieces of material to fine powder. An example is coal which is reduced from nuggets to powder before being burned in certain types of power station furnace. Limestone, chalk and many other minerals must also, for most uses, be reduced to powder form.

Breaking up of the rock and grinding it into powder has, to the best of Applicant's knowledge, heretofore mainly been carried out mechanically. Ball mills, hammer mills and other mechanical structures which have moving parts that impact on, and hence crush, the pieces of material are widely used.

It has also been proposed that pieces of material should be broken up in a moving airstream. In prior U.S. Pat. No. 2,832,454 an airstream is blown at supersonic speed from a nozzle into a draft tube within which its speed falls to subsonic. Particles are sacked into the draft tube through an annular gap between the draft tube and the nozzle and broken up in the draft tube. In U.S. Pat. No. 5,765,766 pieces to be broken up fall into an airflow tube, are carried by the air flow into a disintegration chamber and blown against an anvil which breaks up the pieces. In both these structures the pieces are blown into the disintegration zone by air moving means upstream of the disintegration zone.

In U.S. Pat. No. 3,255,793 air is sucked by a centrifugal fan through a tube of circular and constant cross section. The tube is connected to the fan casing in which the fan rotor turns by a diverging conical nozzle. The United States specification states that the pieces entering the nozzle explode due to the fact that the air pressure in the nozzle is below the internal pressure of the particles.

The present invention seeks to provide a new pulveriser and a new method of pulverizing.

BRIEF DESCRIPTION OF THE INVENTION

According to one aspect of the present invention there is provided a pulveriser which comprises an air flow pipe including a venturi, air moving means for inducing an air flow through said venturi at a speed of Mach 1 or faster, and an inlet to said pipe upstream of said venturi through which pieces of frangible material can be fed into said pipe, said air moving means having a suction inlet thereof connected to the outlet of said venturi.

Said air moving means can be a centrifugal fan having its suction inlet co-axial with a fan rotor thereof and its outlet tangential to the fan rotor.

Said venturi may comprise a throat, a convergent portion which decreases in area from an air inlet end thereof to said throat, and a divergent portion which increases in area from said throat to an air outlet end thereof.

Said portions are preferably both circular in cross section.

To prevent pieces of more than a predetermined size reaching said venturi, means for screening the material can be provided. The pulveriser can also comprise means for feeding said solid pieces of material as a stream of pieces which are spaced apart in the direction in which they are travelling.

Said means can be an inclined rotatable feed screw for lifting pieces which have passed through a screen which prevents pieces of greater than predetermined size reaching said screw, the pieces being discharged from the top end of the screw so that they drop into said pipe.

According to a further aspect of the present invention there is provided a method of pulverising frangible material in which air is sucked through a venturi at a speed equal to or in excess of Mach 1, and the pieces of material to be pulverised are entrained in the air flowing to the venturi so that they are carried to the venturi by the flowing air.

To achieve efficient operation without blocking, said pieces are preferably separated into a stream of pieces which reach said venturi in succession. Said material can additionally be screened to prevent material pieces above a predetermined size reaching said venturi.

BRIEF DESCRIPTION OF THE DRAWINGS

For a better understanding of the present invention, and to show how the same may be carried into effect, reference will now be made, by way of example, to the accompanying drawing in which.

DETAILED DESCRIPTION OF THE DRAWINGS

Figure 2:
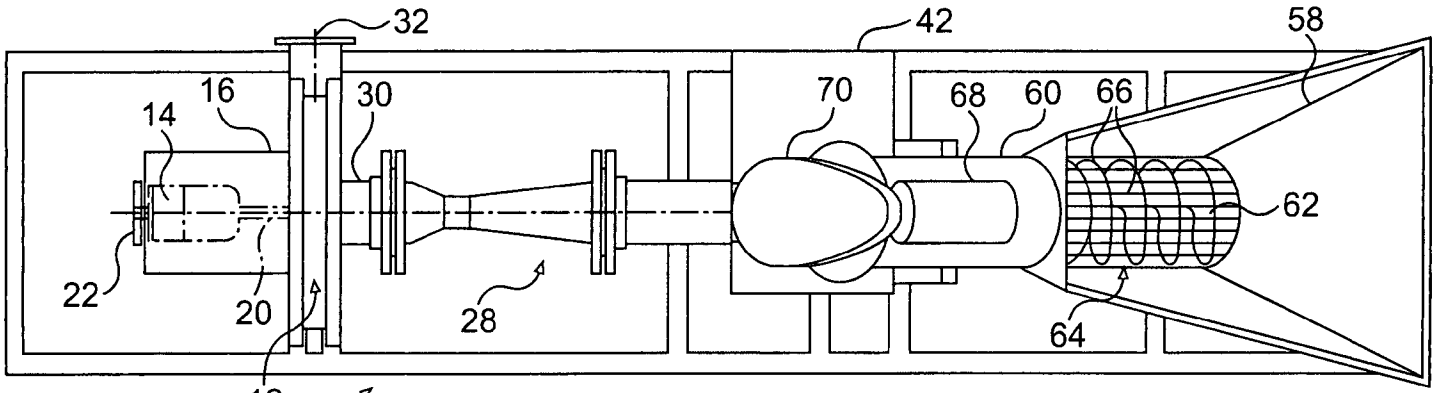
FIG. 2 is a top plan view of the pulveriser.
Figure 1:
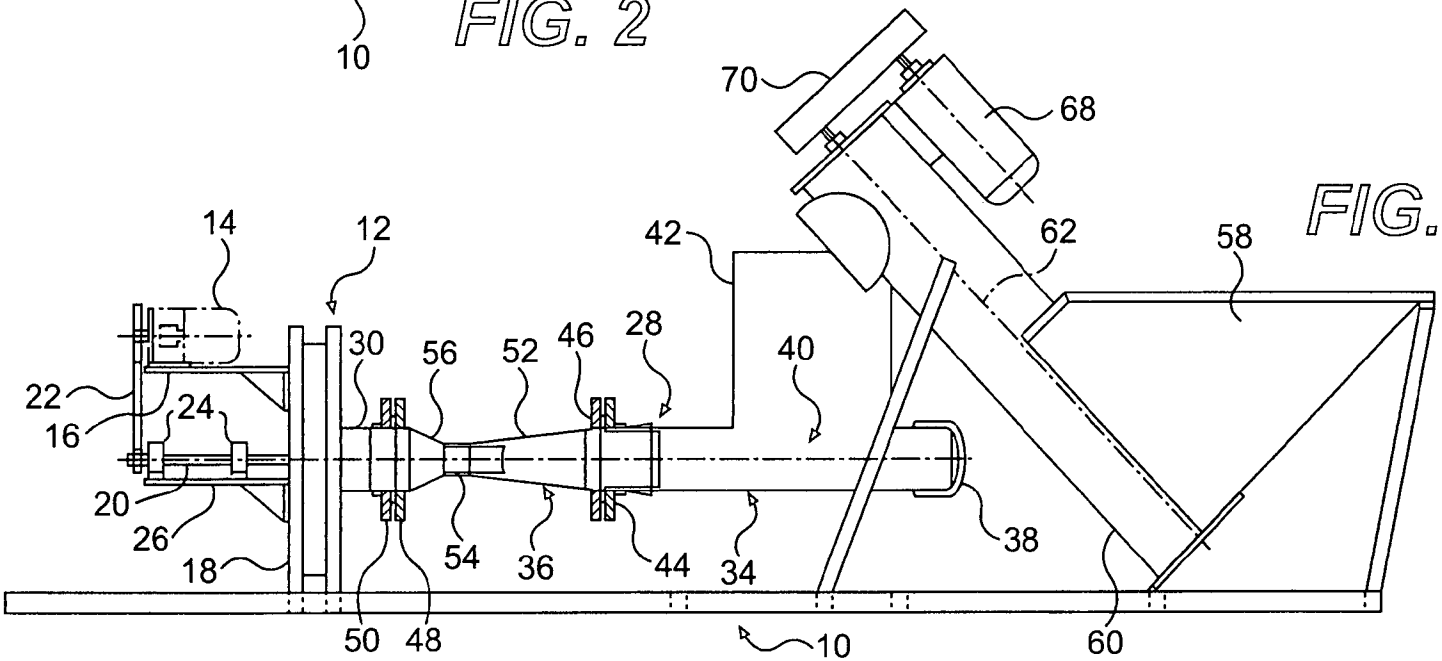
FIG. 1 is a side elevation, partly in section, of a pulveriser in accordance with the present invention.
Figure 3:
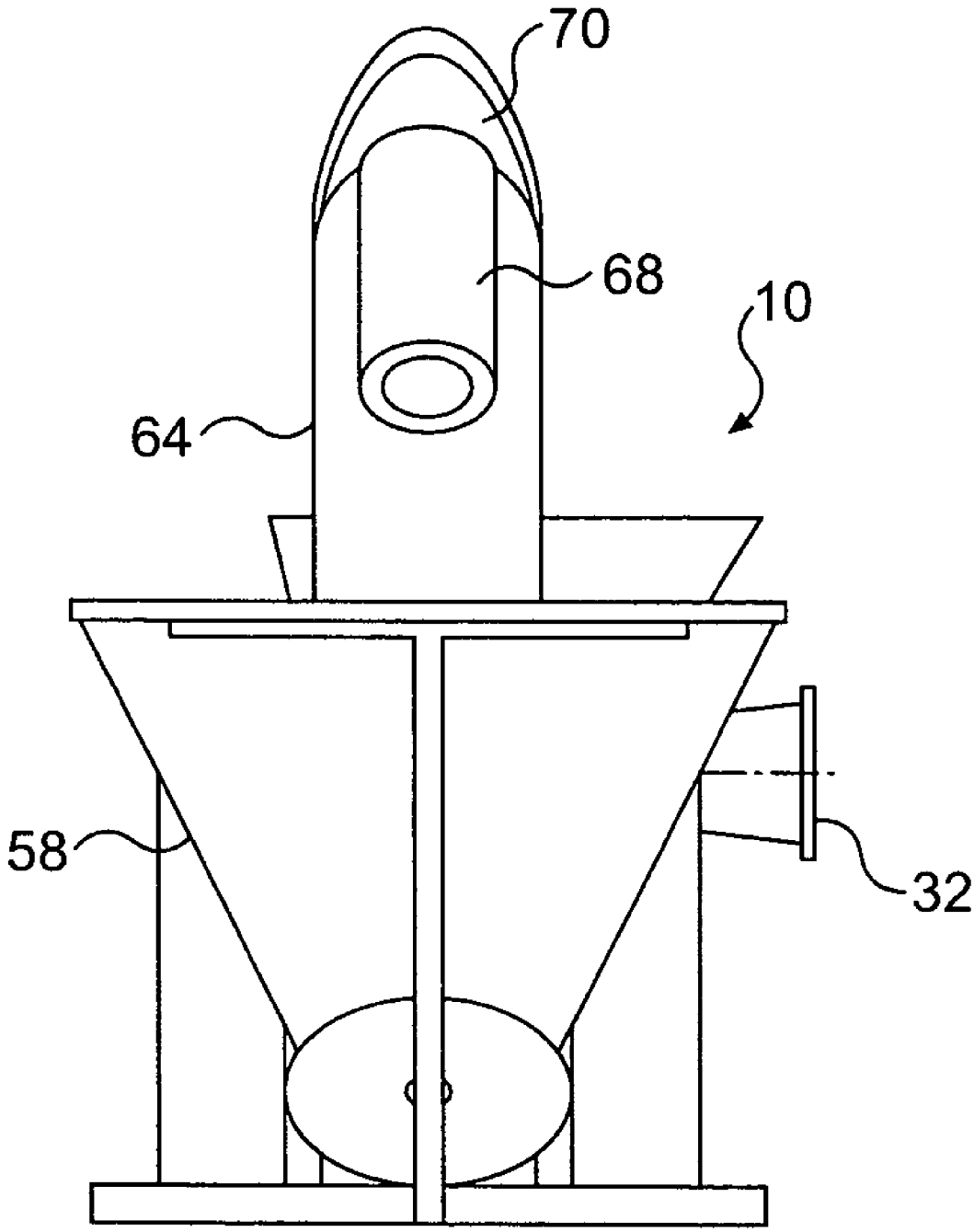
FIG. 3 is a view of the pulveriser from one end.

The pulveriser 10 shown in FIGS. 1 to 3 of the drawing comprises air moving means in the form of a centrifugal fan 12 which is driven by a motor 14. The motor 14 is mounted on a bracket 16 which is itself secured to the casing 18 of the fan 12. The motor 14 is connected to a shaft 20 by way of a drive belt 22. The shaft 20 is carried by bearings 24 which are themselves mounted on a further bracket 26. The bracket 26 is secured to the casing 18. The shaft 20 passes through one of the walls of the casing 18 and the rotor (not shown) of the fan 12 is carried by the part of the shaft 20 which is within the casing 18.

An airflow pipe 28 is connected to the suction inlet 30 of the casing 18. It will be understood that the suction inlet 30 of the centrifugal fan is co-axial with the fan's rotor and drive shaft 20. The fan's outlet (see FIGS. 2 and 3) is on the periphery of the casing 18 and is designated 32.

The pipe 28 includes two sections 34 and 36. The section 34 is cylindrical in shape and the right hand end thereof, as viewed in FIGS. 1 and 2, constitutes the inlet to the pipe 28. The inlet is covered by a filter 38. The section 34 has an elongate opening 40 in the upper part thereof, the opening 40 communicating with the open lower end of a hopper 42. The hopper 42 is open at its upper end.

The inlet 30 is of the same diameter as the section 34.

At the left hand end of the section 34, as viewed in FIGS. 1 and 2, there is a flange 44 and at the right hand end of the section 36 there is a flange 46. The flanges 44 and 46 are bolted or otherwise secured together. The section 36 has a second flange 48 by means of which the section 36 is bolted to a flange 50 of the inlet 30.

The section 36 is in the form of a venturi. More specifically, the section 36 includes a tapering portion 52 which progressively reduces in diameter from the flange 46 to a cylindrical portion 54 which is of smaller diameter than the section 34. The portion 54 constitutes a throat. Between the portion 54 and the flange 48 there is a divergent portion 56 which progressively increases in diameter in the direction of air flow. The portion 52 is longer than the portion 56 and hence the angle at which it tapers is smaller.

Solid pieces of frangible material are dumped into a storage hopper 58 which is open at its upper end and closed at its lower end. The lower end of the hopper is constituted by an inclined cylindrical wall 60 co-axial with which there is an inclined feed screw 62. A screen 64 (FIG. 2) comprising a series of parallel bars 66 prevents oversized pieces of material from entering the feed screw 62. The screw 62 lifts the solid pieces and drops them into the hopper 42 through which they fall into the pipe 28. The arrangement is such that it provides a stream of spaced apart pieces of material to the pipe 28, none of the pieces exceeding a predetermined size. The screw 62 is driven by a motor 68 via a transmission 70.

Figure 4:
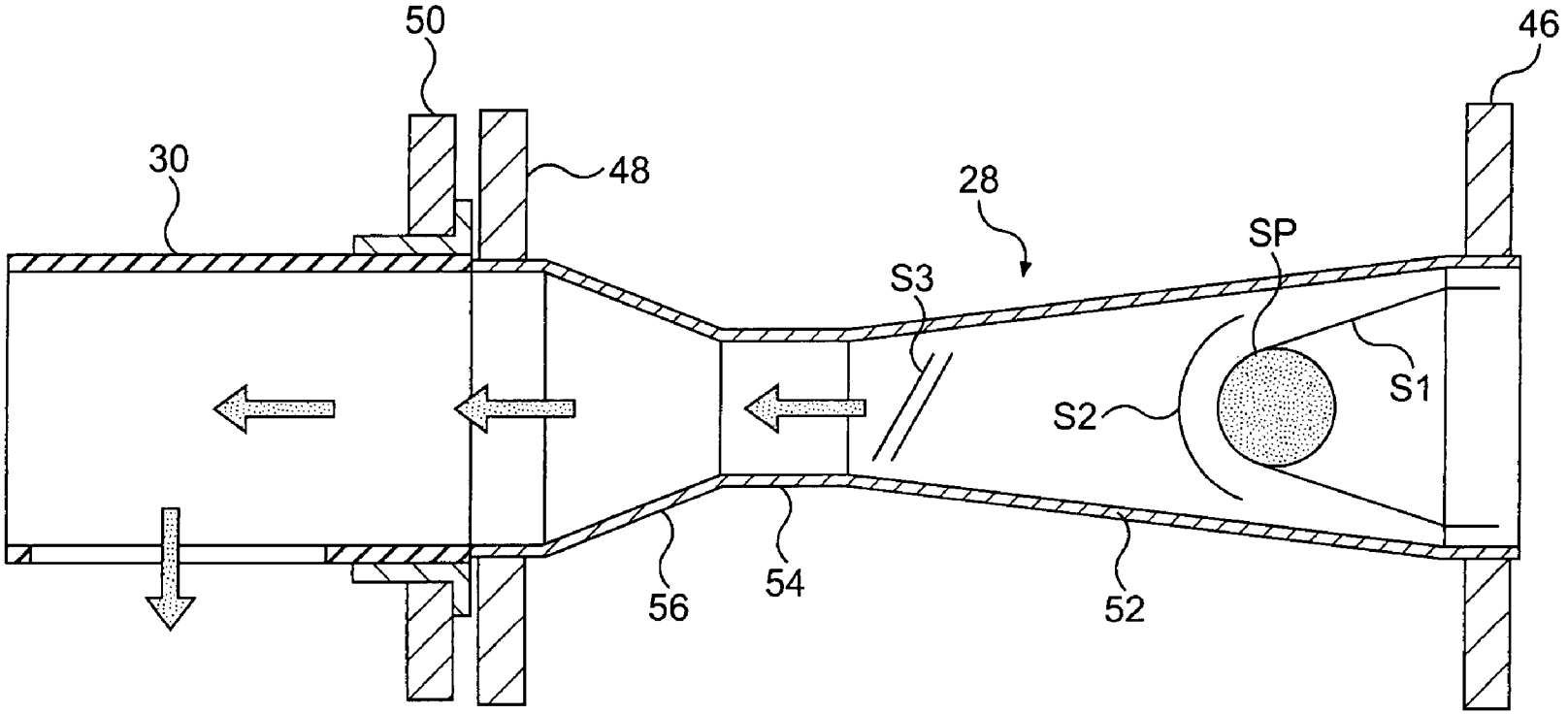
FIG. 4 illustrates, to a larger scale, the operation of the pulveriser.

FIG. 4 diagrammatically illustrates the way in which Applicant believes the pulveriser operates.

A solid piece of material SP which has passed between the bars 66 of the screen 64 and has been lifted by the screw 62 into the hopper 42 falls into the pipe 28 and is propelled along the pipe by the flowing airstream. The piece of material is smaller than the section 34 and there is hence a gap between the inner surface of the section 34 and the piece SP. As the piece SP enters the tapering portion 52, the gap gets narrower and eventually the piece SP causes a substantial reduction in the area of the portion 52 through which air can flow. A recompression shock wave S1 trails rearwardly from the solid piece and a bow shock wave S2 builds up ahead of the solid piece. Where the portion 52 merges with the portion 54 there is a standing shock wave S3. It is believed that it is the action of these shock waves on the solid piece SP that disintegrates it.

The material which emerges from the fan is in the form of a fine powder. The pulveriser, ignoring the fan noise, does not make any significant noise. Reduction of, say, a piece of coal-to coal dust is accompanied by a short burst of sound which Applicant believes is caused by the disintegration of the solid piece as the shock waves impinge on it.

The pulveriser illustrated in FIGS. 1 to 3 has the following technical features:

Motor rating—6 kW using a three phase 380 v power supply;
Fan rotor speed 5000 rpm;
Fan rotor diameter 300 mm;
Length of portion 52 . . . 40 mm;
Length of portion 54 . . . 70 mm;
Length of portion 56 . . . 360 mm;
Distance between the flange 44 and the hopper 42 . . . 790 mm;
Diameter of section 34 . . . 160 mm;
Diameter of portion 54 . . . 70 mm
Rate of air flow at 5000 rpm, 50 cubic feet per minute.

Tests carried out thus far on a prototype indicate that an air speed of Mach 1 is achieved at the throat where the portions 52 and 54 merge. Applicant believes that the standing supersonic shock wave S3 is created at this zone, and that there is a very high pressure differential across this shock wave. This differential plays a not insignificant part in disintegrating to dust a piece of material passing through this shock wave.

Broken glass, limestone, coal and broken bricks have been successfully reduced to powder in the pulveriser described.

What is claimed is:

1. A method of pulverising frangible material, comprising:
placing an inlet of an air flow means in communication with a venturi,
the air flow means sucking air through an air inlet located upstream of the venturi and then through the venturi,
wherein a flow through the venturi is at a speed equal to or in excess of Mach 1, and
feeding pieces of the frangible material to be pulverised in the air flowing to the venturi at a point between said air inlet and said venturi,
wherein said feeding entrains said pieces of the frangible material in the air flowing to the venturi and carries the pieces to the venturi by the flowing air.

2. The method of claim 1, further comprising:
separating said frangible pieces into a stream of pieces which reach said venturi in succession.

3. The method of claim 2, further comprising:
screening said frangible material and preventing material pieces larger than a predetermined size from reaching said venturi.

4. The method of claim 1, further comprising:
pulverising the frangible material by a shock wave acting at an upstream position with respect to the venturi,
wherein said shock wave is produced by an interaction between the frangible material, the flowing air, and the venturi.

5. The method of claim 1, wherein said venturi comprises:
a throat,
a convergent portion which decreases in a first cross-sectional area from an air inlet end thereof to said throat, and
a divergent portion which increases in a second cross-sectional area from said throat to an air outlet end thereof.

6. The method of claim 5, wherein said convergent and divergent portions are both circular in cross section.

7. The method of claim 1, further comprising:
screening the frangible material and preventing pieces of greater than a predetermined size from reaching said venturi.

8. The method of claim 1, wherein feeding comprises:
feeding said pieces of frangible material as a stream of pieces which are spaced apart in a direction in which said stream of pieces is traveling.

9. The method of claim 1, wherein said means for feeding comprises an inclined rotatable feed screw.

10. A method of pulverising material, comprising:
placing an air flow means in communication with a venturi;
the air flow means generating an air flow traversing through the venturi and towards the air flow means;
introducing material to be pulverised into the air flow; and
the material passing through the venturi and into the air flow means.

11. The method of claim 10, wherein the material includes frangible pieces and the method further comprises separating the frangible pieces into a stream of pieces which reach the venturi in succession.

12. The method of claim 11, further comprising:

screening the frangible pieces; and preventing the frangible pieces larger than a predetermined size from reaching the venturi.

13. The method of claim 10, wherein the venturi is circular in cross section.

14. The method of claim 10, further comprising coupling an inlet to the venturi such that the air flow traverses through the inlet.

15. The method of claim 14, wherein introducing material into the air flow includes introducing material into the inlet.

16. The method of claim 10, wherein placing an air flow means in communication with a venturi includes coupling a suction inlet of the air flow means to an outlet of the venturi.

* * * * *

UNITED STATES PATENT AND TRADEMARK OFFICE

CERTIFICATE OF CORRECTION

PATENT NO. : 6,978,953 B2
APPLICATION NO. : 10/750901
DATED : December 27, 2005
INVENTOR(S) : William Graham It is certified that error appears in the above-identified patent and that said Letters Patent is hereby corrected as shown below:

On the title page item (63), line 3, "Related U.S. Application Data" "...PCT/AZ99/00074." Change to -- PCT/ZA99/00074.--

Column 1, line 8 "...Pat..." change to -- Pat. --.

Column 1, line 37, "...sacked..." change to -- sucked --.

Column 3, line 49, "...coal-to..." change to -- coal to --.

Signed and Sealed this

Twenty-sixth Day of December, 2006

JON W. DUDAS
*Director of the United States Patent and Trademark Office*